US006668395B1

(12) United States Patent
Chen

(10) Patent No.: US 6,668,395 B1
(45) Date of Patent: Dec. 30, 2003

(54) ROLL-IN FUTON BED

(75) Inventor: Sufang Chen, Whittier, CA (US)

(73) Assignee: Coaster Company of America, Inc., Santa Fe Springs, CA (US)

( * ) Notice: Subject to any disclaimer, the term of this patent is extended or adjusted under 35 U.S.C. 154(b) by 0 days.

(21) Appl. No.: 10/147,930

(22) Filed: May 16, 2002

(51) Int. Cl.[7] ..... A47C 17/17
(52) U.S. Cl. ..... 5/47; 5/37.1; 5/38
(58) Field of Search ..... 5/47, 37.1, 38, 5/41, 42, 48, 55.1; 297/67, 69, 63, 354.13

(56) References Cited

U.S. PATENT DOCUMENTS

| | | | | |
|---|---|---|---|---|
| 1,949,252 A | | 2/1934 | Gransden | |
| 2,858,550 A | * | 11/1958 | Richter | 5/47 |
| 2,937,382 A | | 5/1960 | Laemmle et al. | |
| 3,002,198 A | | 10/1961 | Kaiser, Jr. | |
| 3,162,481 A | | 12/1964 | Gaylor | |
| 3,856,347 A | | 12/1974 | Bell et al. | |
| 4,365,369 A | | 12/1982 | Plume | |
| 4,939,802 A | * | 7/1990 | Lafer | 5/42.1 |
| 5,153,952 A | | 10/1992 | Barton et al. | |
| 5,327,591 A | | 7/1994 | Fireman et al. | |
| 5,519,902 A | | 5/1996 | Meade | |
| D392,115 S | | 3/1998 | Olender | |
| 5,940,907 A | | 8/1999 | Stoler et al. | |
| 5,971,483 A | | 10/1999 | Brenneman | |
| 6,015,186 A | * | 1/2000 | Grieger | 297/67 |

* cited by examiner

*Primary Examiner*—Teri Pham Luu
*Assistant Examiner*—Fredrick Conley
(74) *Attorney, Agent, or Firm*—Charles H. Thomas

(57) ABSTRACT

An article of furniture is provided which can be transformed easily from a bed to a futon or a chaise lounge. The article of furniture is formed of a stationary, generally U-shaped upright support having a head frame with opposing ends from which side frames extend in mutual parallel alignment. A base frame assembly is mounted upon wheels or other roller elements and is comprised of a plurality or articulated frames, including a seat bench frame located remote from the head frame of the stationary support, and at least an intermediate seat back frame hinged to the bench frame. Preferably, a proximal back frame is also provided which includes within its structure a backrest that may be raised or lowered when the unit is used as a chaise lounge. The article of furniture is provided with rollers on each side of the stationary support near the distal extremities thereof. Cam latches are provided on opposing sides of the seat frame in longitudinal alignment with the rollers. The cam latches include concave downwardly facing seating recesses and cam surfaces that are inclined longitudinally and upwardly therefrom, toward the head frame. When the article is to be utilized as a futon, the seat bench frame is moved to engage the cam latches with the rollers so that the cam surfaces of the cam latches ride up the rollers and the seating recesses lodge on the rollers in releaseable latching engagement therewith when moved into registration with the rollers.

20 Claims, 11 Drawing Sheets

ROLL-IN FUTON BED

BACKGROUND OF THE INVENTION

1. Field of the Invention

The present invention relates to an article of furniture that is useful as a futon and which may also be easily converted into a bed or a chaise lounge.

2. Description of the Prior Art

A futon is generally considered to be an article of furniture that may be used as a bed, but which may be configured so as to have a back and bench shaped as a couch for occupancy, usually by a single person. Unlike a couch, a futon does not have arms on its sides.

Various articles of furniture have been constructed with a feature of convertibility whereby a futon can be converted to a bed. In such an arrangement the back of the futon is constructed so as to be alternatively oriented in a flat disposition relative to the seat bench, so as to form a flat bed. Alternatively, the back support section can be oriented to an upright, slightly inclined disposition relative to the seat bench so that the article of furniture becomes a futon.

Some prior devices have been constructed so that the seat bench portion of the furniture article slides or rolls into a frame, or is alternatively extended from a frame, depending upon whether the article of furniture is to serve as a futon or as a bed. However, all prior devices of this type are somewhat cumbersome to operate or inordinately expensive to build.

SUMMARY OF THE INVENTION

One object of the present invention is to provide an article of furniture that is convertible as between a bed and a futon in which the movable seat bench portion can be easily rolled into a stationary frame in such a manner as to easily, but releaseably latch in position relative to the outer, stationary frame. In addition, the article of furniture is constructed so that the seat bench latch will not readily become disengaged in an unexpected manner, but which can easily be purposefully disengaged to draw the seat bench out away from the outer frame, if desired.

A related object is the provision of a convertible futon bed in which the futon seat bench can be easily disengaged from the outer frame and rolled out away from the head frame of the outer support to collapse the portions of the base frame assembly into a flat bed frame. The seat bench can also easily rolled back in toward the head frame to create a futon seat back located behind the futon seat bench. The article of furniture of the invention is provided with cam latches that firmly, but releaseably secure the futon seat bench in front of the seat back frame for use as a seating support.

Another object of the invention is to provide a roll-in futon that can alternatively be deployed as either a flat bed or a chaise lounge.

In one broad aspect the invention may be described as a convertible article of furniture comprising a stationary outer support and a movable base frame assembly. The outer support is formed with a central, transverse head frame from both ends of which mutually parallel side frames extend longitudinally in spaced separation from each other. The movable base frame assembly is supported on rolling members such as wheels, rollers, or casters, for longitudinally reciprocal movement relative to the stationary outer support and between the side frames. The movable base frame assembly has a longitudinally distal seat bench frame remote from the head frame and an intermediate back frame located between the seat bench frame and the head frame. The seat bench frame and the intermediate back frame are hinged to each other. The side frames of the stationary outer support are each provided with a roller located remote from the heat frame. The rollers are oriented for rotation about horizontal roller axes that are perpendicular to the side frames. The seat bench frame has a distal portion longitudinally remote from the head frame. The seat bench frame also has cam latches with arcuate, downwardly facing concave seating recesses defined therein projecting downwardly from its distal portion.

The cam latches include longitudinally oriented cam surfaces inclined in a direction downwardly and away from the head frame and toward the seating recesses. As a result, as the seat bench frame approaches the head frame, the cam surfaces ride up the rollers to elevate the longitudinally distal portion of the seat bench frame and then releaseably lodge the concave seating recesses upon the rollers. The seat bench frame and intermediate seat back frame are typically provided with a conventional cushioning pad so as to afford a measure of comfort to the user or users.

In another broad aspect the invention may be considered to be an improvement in an article of furniture having a stationary support with upright, mutually parallel opposing sides and a base frame assembly movable between the opposing sides and parallel thereto, and in which the base frame assembly includes a seat bench frame and at least an intermediate seat back frame hinged to the seat bench frame for rotational movement relative thereto. The seat bench frame is provided with supporting rolling members. The improvement of the invention is comprised of a roller on each of the sides of the stationary support. The rollers are oriented for rotation about axes perpendicular to the sides of the stationary supports. Also, cam latches are provided on opposing sides of the seat frame in longitudinal alignment with the rollers. The cam latches include concave downwardly facing seating recesses and cam surfaces inclined longitudinally and upwardly therefrom and toward the intermediate seat back frame. Consequently, when the seat bench frame is moved to engage the cam latches with the rollers, the cam surfaces of the cam latches ride up the rollers and the seating recesses lodge on the rollers in releaseable latching engagement therewith when moved into registration with the rollers.

In still another aspect, the invention may be considered to be a roll-in futon comprising: a stationary outer support and a movable base frame assembly. The stationary outer support is formed with a laterally extending head frame having opposing ends and a pair of mutually parallel side frames at the opposing ends of the head frame. The side frames extend in a footward direction from the head frame. Rollers are rotatably mounted on the side frames for rotation about axes perpendicular thereto. The movable base frame assembly includes a seat bench frame located in a footward direction from the head frame and at least an intermediate back support frame located between the head frame and the seat bench frame and joined by a footward hinge for movement relative to the seat bench frame. The movable base frame assembly also includes cam latches that project downwardly from the seat bench frame and include concave downwardly facing seating recesses and cam surfaces inclined upwardly therefrom and toward the head frame. The rollers engage the cam latches as the intermediate back support frame approaches the head frame, and the rollers lift at least a portion of the seat frame as the cam surfaces ride up the rollers. The seat frame is releaseably lodged relative to the stationary support when the rollers engage the concave seating surfaces of the cam latches.

Preferably, base frame assembly further includes a proximal back frame hinged to the intermediate back frame and located between the intermediate back frame and the head frame. The seat bench frame, the intermediate seat back frame, and the proximal seat back frame are joined together in articulated fashion. The proximal back frame is rotatably secured to the side frames at back frame axle pins located proximate the head frame for rotation relative to the side frames about a proximal back frame axis of rotation perpendicular to the side frames. When the article of furniture is converted to a bed, the proximal back frame lies immediately adjacent to the head frame with the intermediate back frame and the seat bench frame extending longitudinally therefrom in that order in a footward direction.

The cam latching mechanism of the convertible futon is an extremely important aspect of the invention. The cam surfaces of the cam latches are preferably formed on vertical cam plates and are inclined at an angle of between about twenty-five degrees and about forty-five degrees relative to the seat bench frame at the time the rollers first contact the cam surfaces. In the preferred embodiment this angle of inclination is about thirty-three degrees relative to the horizontal orientation of the seat bench frame.

Also, a proper selection of the size and configuration of the rollers and the seating recesses improves the smoothness of latching and unlatching the cam latching mechanism. The rollers have a contact surface diameter typically between about one-half inch and about one and one-half inches, preferably about seven-eighths of an inch. The concave recesses are both preferably shaped with a circular arc at a diameter of between about one and two inches. The arc of the seating recesses can vary somewhat, but normally is between about thirty and ninety degrees. In the preferred embodiment the circular arc of the concave seating recesses is formed at a diameter of about one and three-eighths inches and extends over a circular arc of about sixty degrees.

The invention may be described with greater clarity and particularity by reference to the accompanying drawings.

DESCRIPTION OF THE EMBODIMENT

Figure 1:
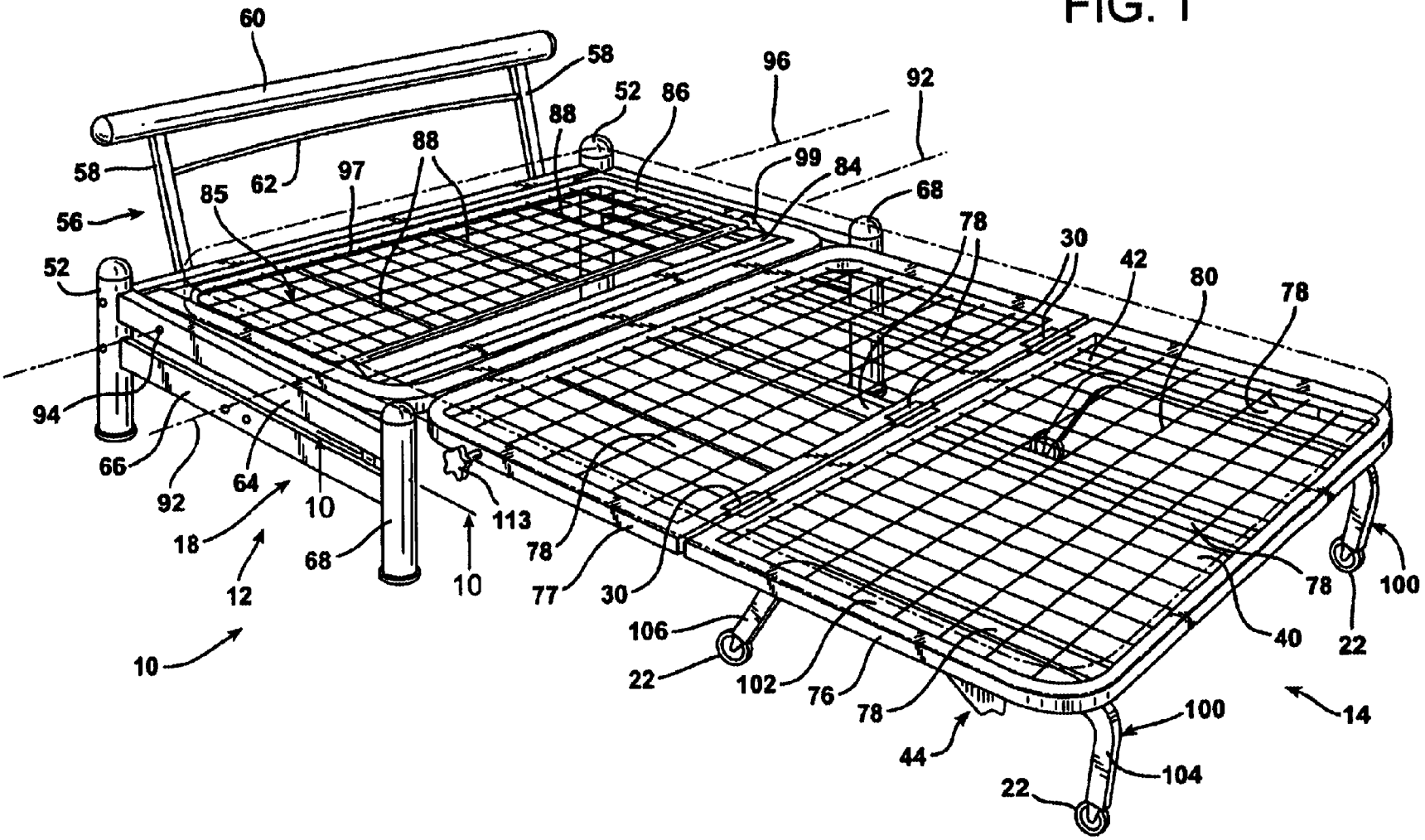
FIG. 1 is a perspective view of an article of furniture according to the invention with the base frame assembly extended from the stationary support to form a bed.
Figure 5:
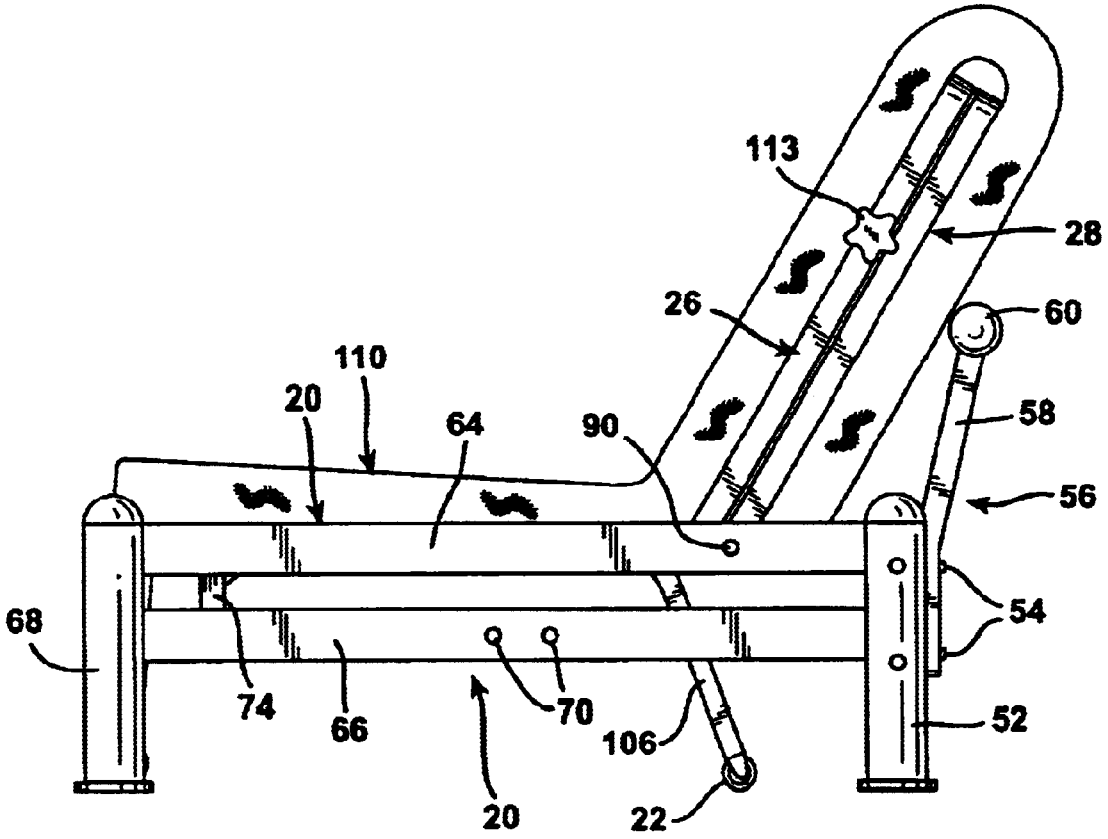
FIG. 5 is a side elevational view illustrating the article of furniture with the base frame assembly completely rolled into the stationary support to convert the article of furniture to a futon.
Figure 6:
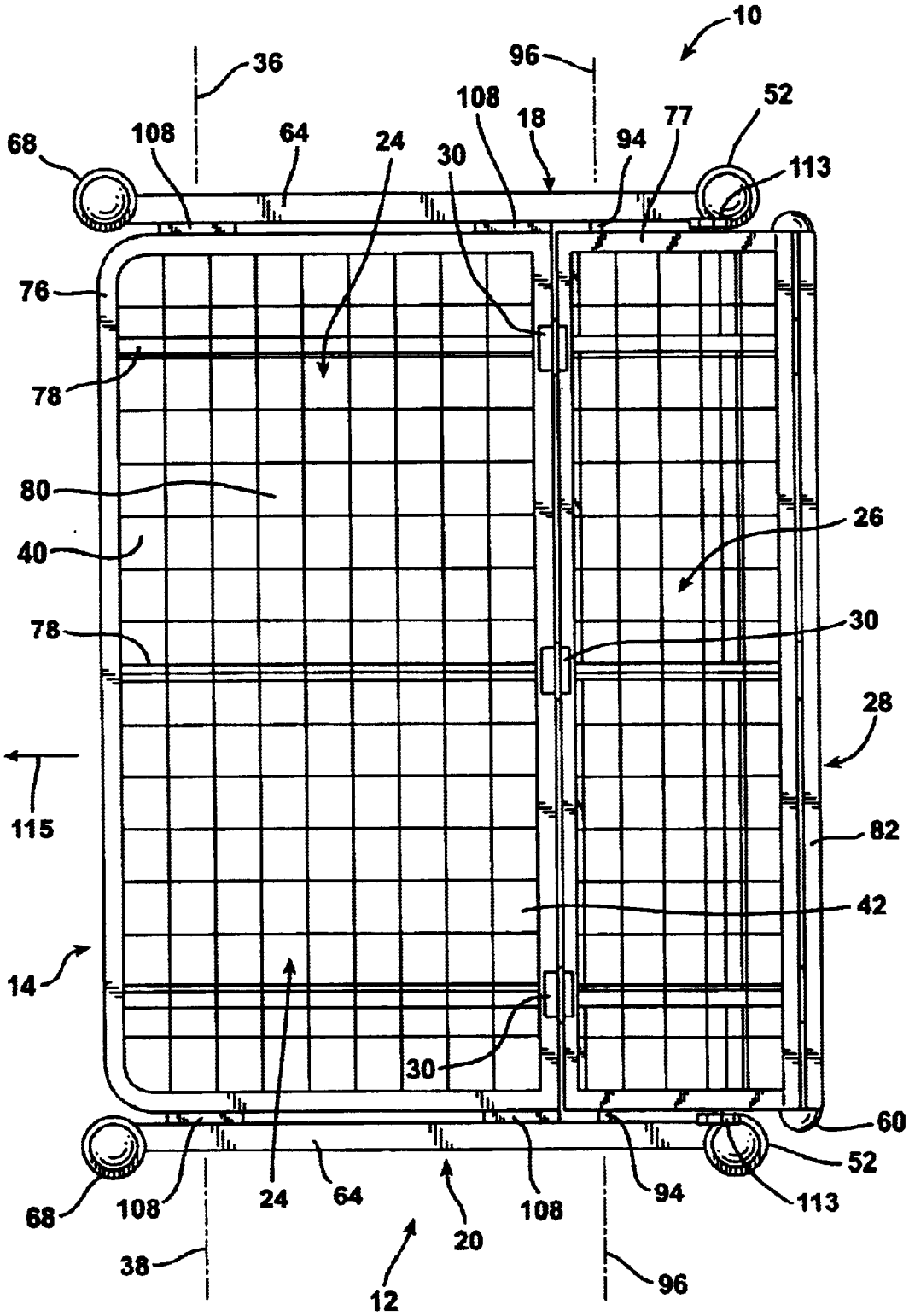
FIG. 6 is a top plan view of the article of furniture converted to a futon as shown in FIG. 5, but with the padding omitted for clarity of illustration.

FIG. 1 illustrates an article of furniture indicated generally at 10 that is comprised of a stationary support 12 and a base frame assembly 14 that is movable in a longitudinal direction relative to the stationary support 12. The stationary outer support 12 is formed with a central, transverse head frame 16 from both ends of which mutually parallel side frames 18 and 20 extend longitudinally in uniform spaced separation from each other, as shown in FIG. 6. The movable base frame assembly 14 is supported on rolling members, which preferably are wheels 22, as shown in FIGS. 1–5. The wheels 22 allow the base frame assembly 14 to be longitudinally moved in reciprocal fashion relative to the stationary outer support 12 and between the side frames 18 and 20. The base frame assembly 14 has a seat bench frame 24, an intermediate back frame 26, and a proximal back frame 28. The terms proximal and distal as utilized herein refer to relative proximity to the head frame 16. The direction "footward", as utilized herein refers to the direction away from the head frame 16 and between and parallel to the side frames 18 and 20, indicated by the directional arrow 115 in FIG. 6.

Figure 2:
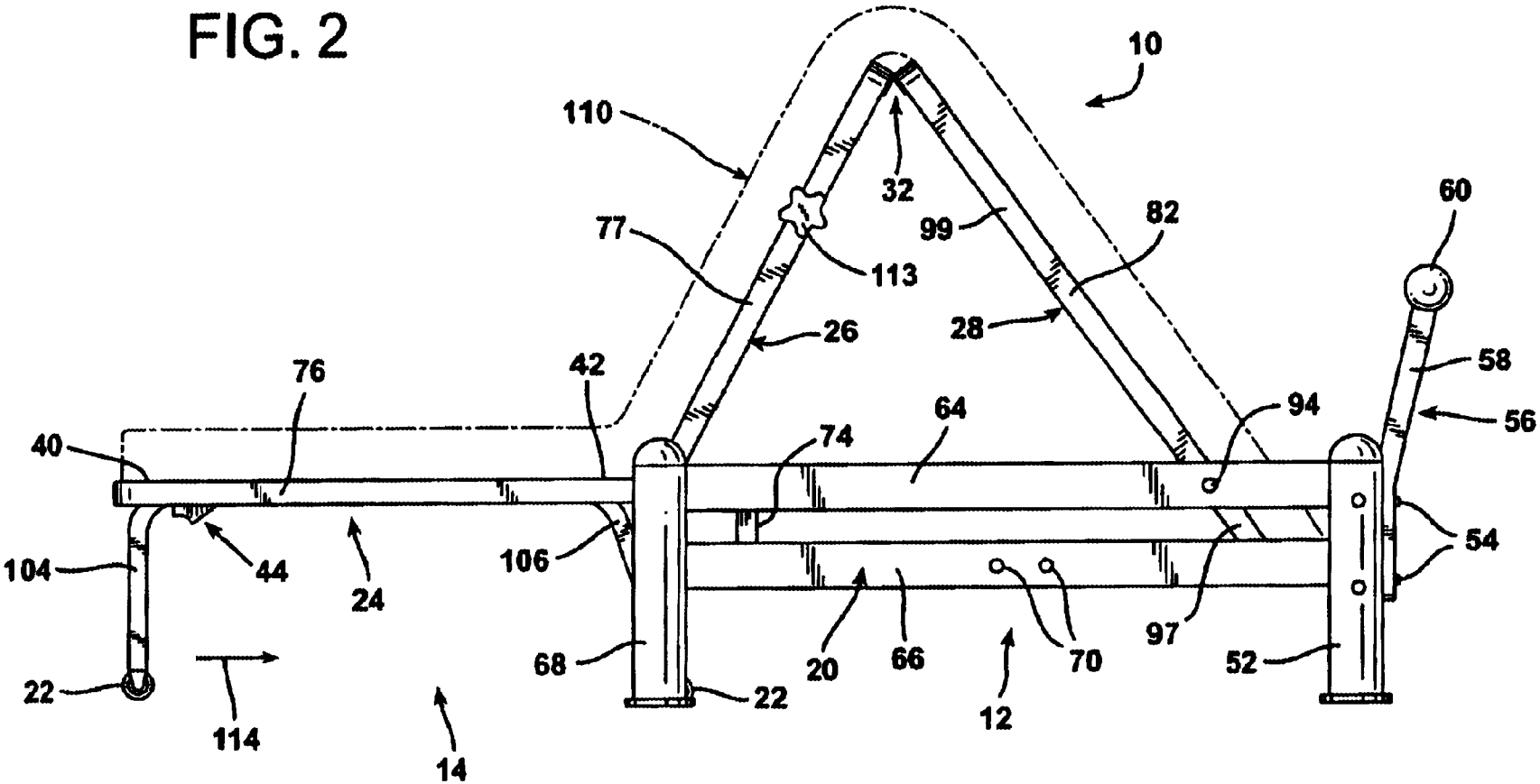
FIG. 2 is a side elevational view illustrating the article of furniture of FIG. 1 while the base frame assembly is being pushed toward the head frame to convert the bed of FIG. 1 to a futon.

The seat bench frame 24 is located in a longitudinally distal relationship with respect to the head frame 16 and the intermediate back frame 26 is located between the seat bench frame 24 and the head frame 16. The proximal back frame 28 is located between the intermediate back frame 26 and the head frame 16. As shown in FIG. 1, the seat bench frame 24 and the intermediate back frame 26 are joined to each other by hinges 30 on their top sides, while the intermediate back frame 26 and the proximal back frame 28 are joined together by hinges 32 on their bottom sides, as illustrated in FIG. 2. The seat bench frame 24, the intermediate back frame 26, and the proximal back frame 28 are thereby hinged together in articulated fashion for rotation relative to each other about axes of rotation perpendicular to the side frames 18 and 20.

Figure 10:
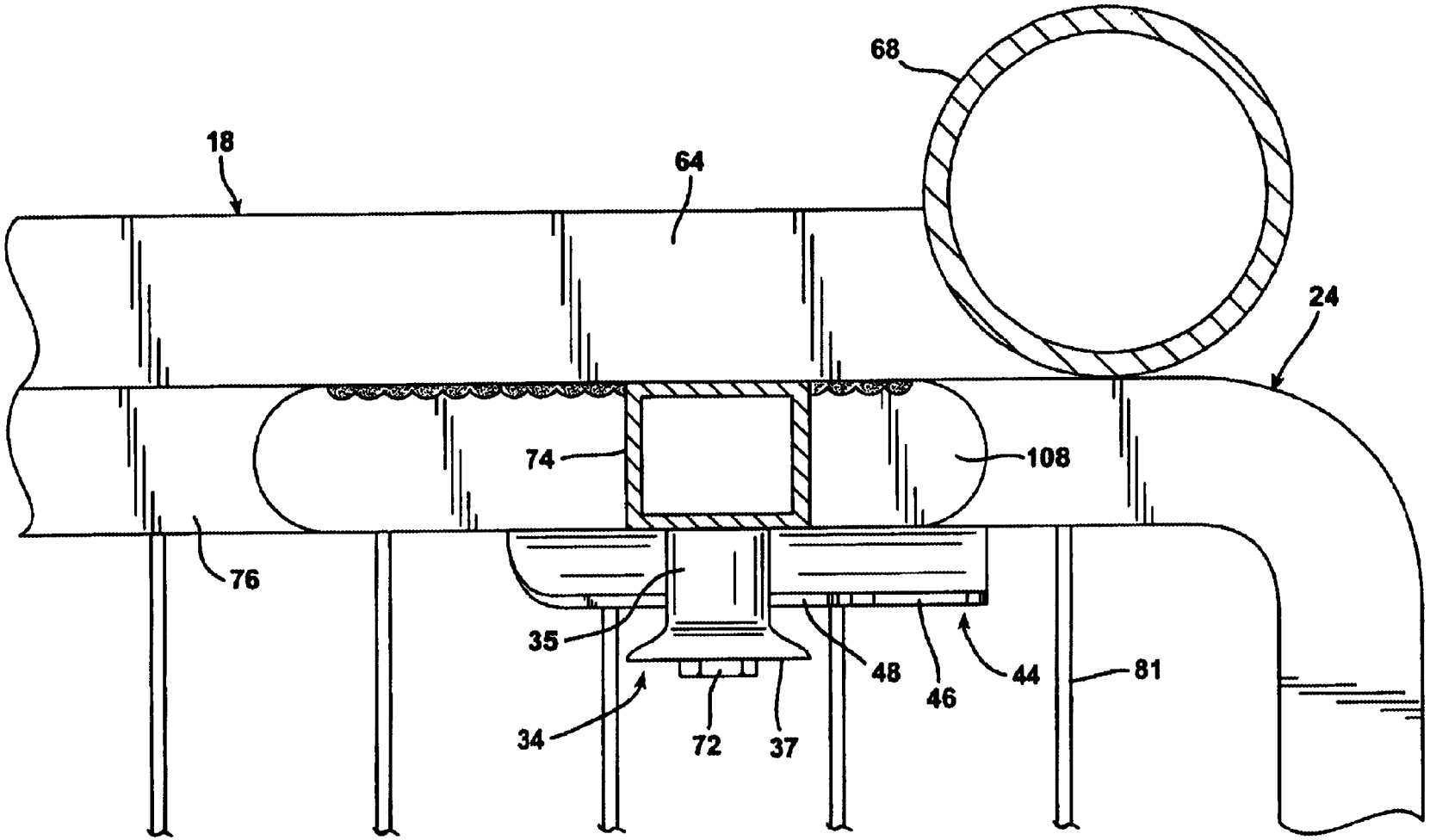
FIG. 10 is a bottom plan detail taken along the lines 10—10 of FIG. 1.

As illustrated in FIGS. 7 through 11, the side frames 18 and 20 are each provided with a roller 34 located remote from the head frame 16 and oriented for rotation about horizontal roller axes 36 and 38, which are in coaxial, transverse alignment with each other, as illustrated in FIG. 6. The rollers 34 have cylindrical rolling contact surfaces 35 and are flared outwardly at their extremities to form generally frustoconical-shaped retaining guards 37, as illustrated in FIG. 10. The roller axes 36 and 38 are perpendicular to the side frames 18 and 20.

The seat bench frame 24 has a longitudinally distal or footward portion 40 located remote from the head frame 16 and a longitudinally proximal portion 42 which is joined by the hinges 30 to the intermediate back frame 26.

Figure 11:
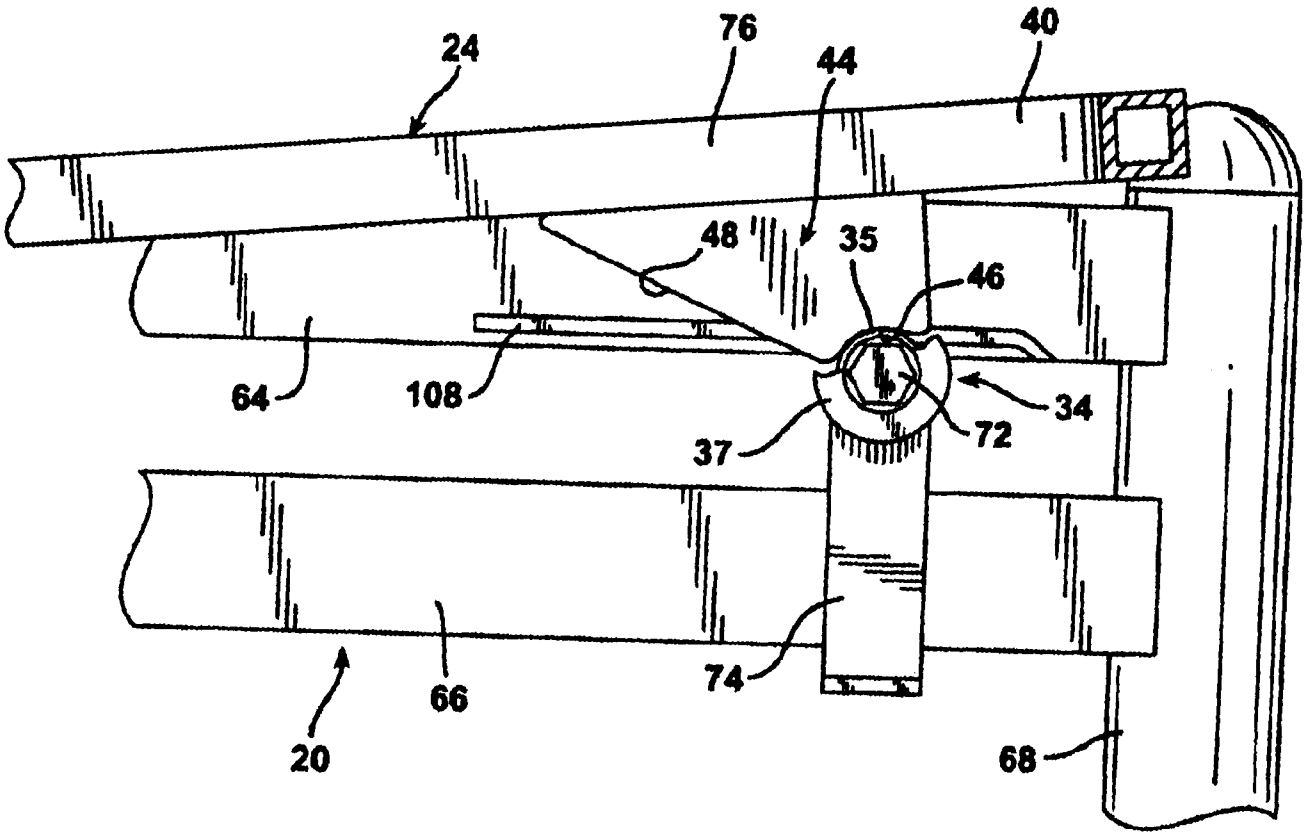
FIG. 11 illustrates the cam latch mechanism engaged with the base frame assembly completely rolled into the stationary outer support, taken along the lines 11—11 of FIG. 6, and with the roller partially broken away.

A pair of cam latches 44 are located on the underside of the longitudinally distal portion 40 of the seat bench frame 24 near the transverse outboard extremities of the seat bench frame 24. As illustrated in FIGS. 7–11, the cam latches 44 are formed of angle sections of steel, the horizontal portion of each of which is welded to the underside of the seat bench frame 24. The vertical portions of the cam latches 44 are formed as plates that extend downwardly and are configured with arcuate, downwardly facing concave seating recesses 46 and longitudinally oriented cam surfaces 48. The cam surfaces 48 are inclined in a direction downwardly and away from the head frame 16 and toward the seating recesses 46, which are located at the distal extremities of the inclined cam surfaces 48. As can be seen in FIGS. 7–11, as the seat bench frame 24 approaches the head frame 16, the cam surfaces 48 ride up the rollers 34 to elevate the longitudinally distal portion 40 of the seat bench frame 24 slightly, and then releaseably lodge the concave seating recesses 46 upon the contact surfaces 35 of the rollers 34, as illustrated in FIG. 11.

Together, the rollers 34 and cam latches 44 form releaseable cam latch assemblies between the opposing sides of the seat bench frame 24 and the side frames 18 and 20. When the seating recesses 46 of the cam latches 44 are engaged with the rollers 34, the article of furniture 10 is configured as a futon for seating, as illustrated in FIGS. 5 and 6.

The head frame 16 is formed of a pair of vertically spaced, mutually parallel tubular steel head rails 50 that extend transversely across the width of the article of furniture 10. The head rails 50 terminate at hollow, cylindrical, upright proximal headboard posts 52 at the longitudinally proximal extremities of the side frames 18 and 20. The head frame 16 also includes a head frame backing structure 56 formed of a pair of upright standards 58 the upper portions of which are inclined slightly away from the side frames 18 and 20. The lower ends of the standards 58 are fastened to the rails 50 by bolts 54. A transverse, tubular, cylindrical upper head guard 60 is welded to the upper extremities of the upright head frame standards 58 so that the head guard 60 is held in a horizontal, transverse orientation. A stiffening rod 62 is located about four inches beneath the head guard 60 and is oriented parallel thereto. The ends of the stiffening rod 62 are welded to the upright standards 58.

Each of the side frames 18 and 20 is comprised of a pair of longitudinally extending rails, including an upper rail 64 and a lower rail 66. The rails 64 and 66 extend longitudinally, parallel to each other and terminate at distal, upright, stationary support posts 68, to which they are welded. The longitudinal rails 64 and 66 of the side frames 18 and 20 are also welded to the proximal support posts 52. A U-shaped center reinforcing frame (not visible) spans the distance between the lower rails 66. The legs of the reinforcing center frame are fastened to the side rails 66 by bolts 70 at a spaced distance of separation from the plane of the transverse head frame rails 50.

As illustrated in FIGS. 7–11, the rollers 34 are mounted for rotation on steel spindles 72 having hexagonal retaining heads that project transversely and inwardly toward each other from upright, square, tubular mounting posts 74. The mounting posts 74 are welded to the inside surfaces of the lower longitudinal rails 66 of the side frames 18 and 20. The rollers 34 have generally cylindrical contact rolling surfaces 50 formed at a diameter of about seven-eighths of an inch. The inboard ends of each of the rollers 34 are flared radially outwardly so as to form guards 37 that are larger in diameter than the rolling surfaces 35 to limit any transverse movement of the cam latches 44 relative thereto.

The seat bench frame 24 and the intermediate back frame 26 are both formed with square tubular steel, peripheral members that are joined together in a configuration that is generally rectangular, but with rounded ends at two corners to form a peripheral framework. The seat bench frame 24 has a peripheral framework 76 while the intermediate back frame 26 has a peripheral frame 77. The frameworks 76 and 77 are stiffened by tubular, longitudinally extending stiffening members 78, the ends of which are welded to the interior surfaces of the peripheral frameworks 76 and 77. Wires forming a tight steel mesh 80 are secured across the upper surfaces of the peripheral rims 76 and 77 and the stiffening members 78 and are firmly secured thereto to provide support for a cushioning pad 110 thereon. The mesh opening size of the meshes 80 is preferably about two and three-eighths inches in a transverse direction and about two and five-eighths inches in a longitudinal direction. The term transverse direction, as utilized herein, is a direction parallel to the alignment of the rails 50 of the head frame 16 and perpendicular to the side frames 18 and 20. The term longitudinal direction, as utilized herein, is a direction parallel to the alignment of the rails 64 and 66 of the side frames 18 and 20.

The construction of the proximal back frame 28 differs somewhat from the construction of the seat bench frame 24 and intermediate back frame 26. The proximal back frame 28 also has a peripheral framework 82 formed of tubular steel having a square cross section and shaped generally in the form of a rectangle, rounded at two corners. However, the peripheral framework 82 includes a transverse stiffening rail 84 near its distal end. The proximal back frame 28 is further comprised of an interior backrest 85 having an outer backrest framework 86 located within the confines of the peripheral framework 82. The backrest framework 86 is formed of tubular steel having a circular cross section and is reinforced by longitudinal stiffening ribs 88, also formed of tubular steel having a circular cross section of three-quarter inches in diameter. The wire mesh 80 of the proximal back frame 28 is stretched across and fastened to the backrest framework 86.

The rounded corners of the backrest framework 86 are directed proximally toward the head frame 16, while the opposite ends of the backrest framework 86 terminate in feet 89 that extend into and form part of unidirectional ratchet and pawl backrest inclination adjustment devices 90. The unidirectional ratchet and pawl backrest inclination adjustment devices 90 are conventional mechanisms that may be purchased commercially.

Figure 3:
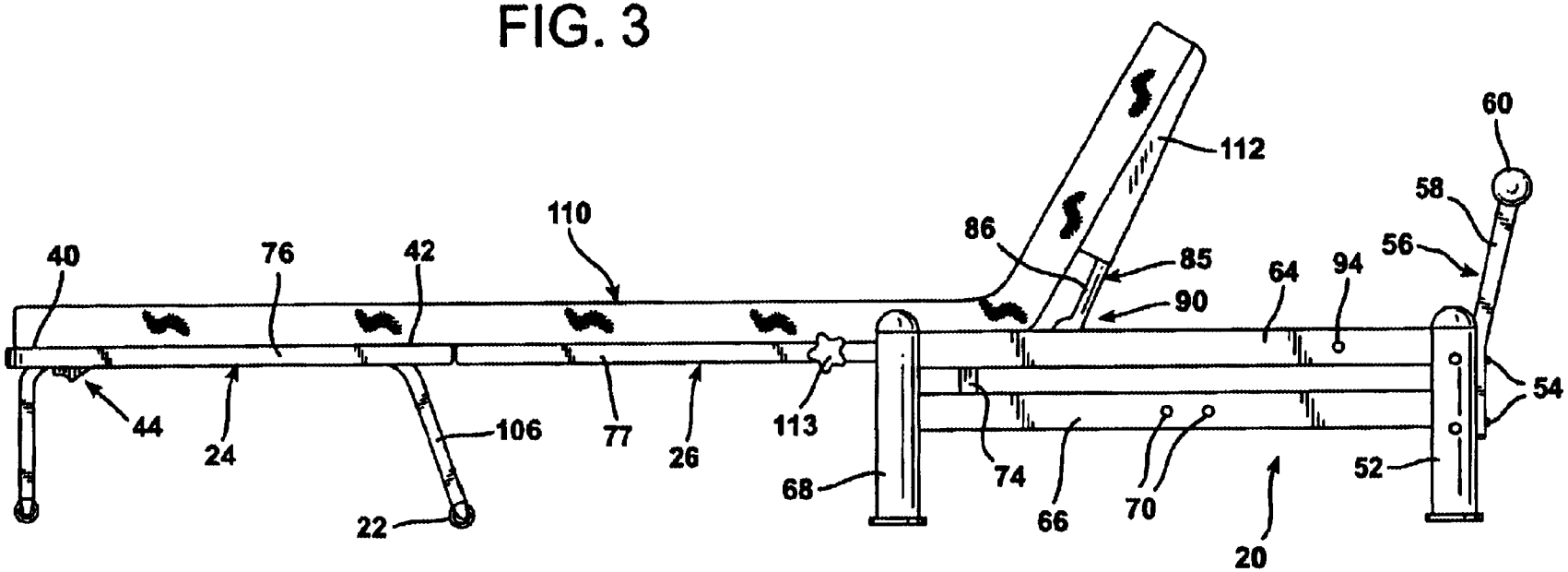
FIG. 3 illustrates the article of furniture of FIGS. 1 and 2 when converted to a chaise lounge.

The feet 89 at the distal end of the backrest framework 86 terminate in disc-shaped appendages lying in vertical, longitudinal planes and are provided with ratchet teeth about their outer peripheries. A spring-loaded pawl within a surrounding housing for the ratchet and pawl mechanisms in the backrest inclination adjustment devices 90 is biased to engage the teeth on the ends of the feet 89 and allow stepwise counterclockwise motion of the backrest framework 86 relative to the peripheral boundary framework 82. The inner peripheral backrest framework 86 may be moved in incremental, counterclockwise steps of rotation, as viewed in FIGS. 3 and 4, relative to the outer peripheral boundary framework 82 to allow the backrest inclination adjustment devices 90 to support the backrest framework 86 at a selected acute angle of inclination relative to the outer peripheral framework 82. That is, with reference to FIGS. 3 and 4, the backrest 85 may be rotated in a counterclockwise direction stepwise, to increase the acute angle between the backrest framework 86 and the outer peripheral framework 82. However, the pawl engagement system prevents clockwise rotation of the backrest framework 86 relative to the peripheral framework 82 when the backrest 86 is at an acute angle relative thereto, as illustrated in FIG. 3.

Figure 4:
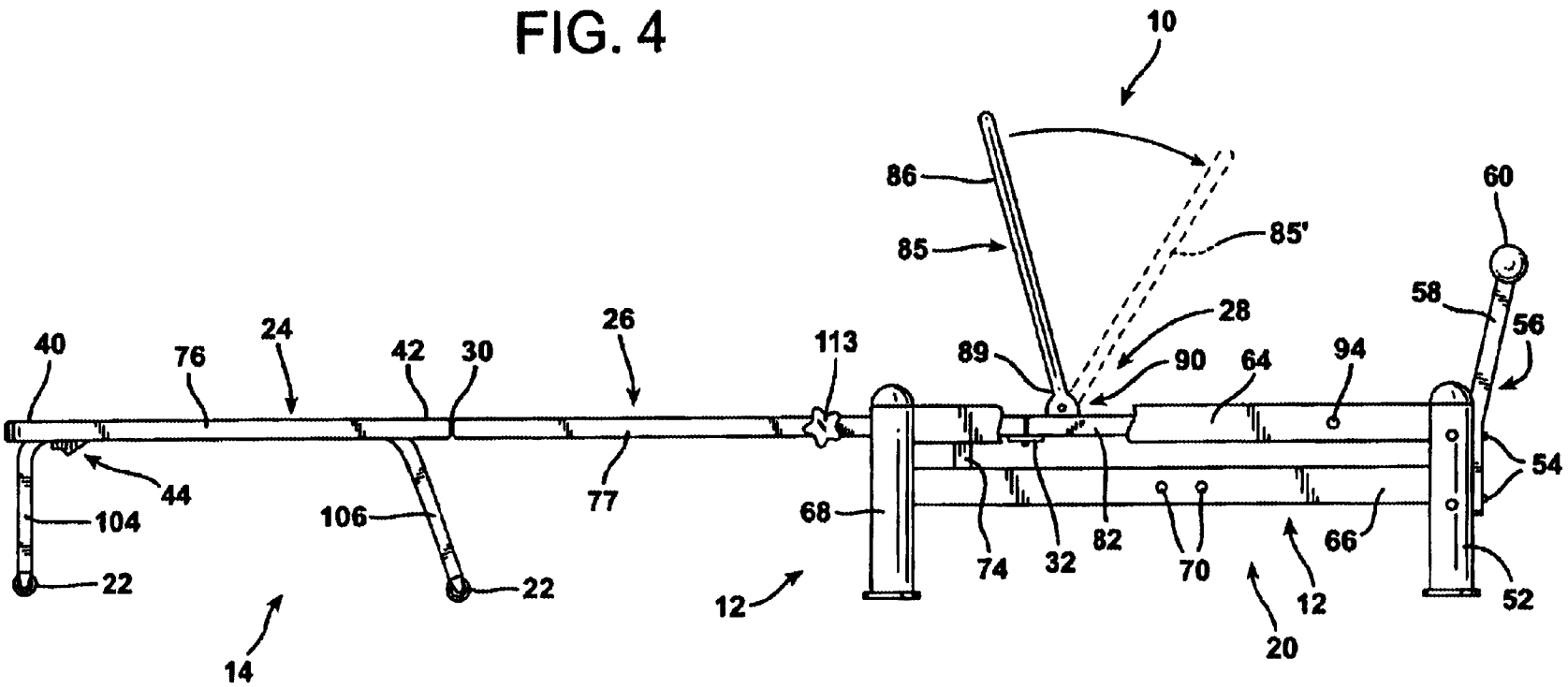
FIG. 4 illustrates the manner in which the angle of inclination of the portion of the base frame may be adjusted when the article of furniture is utilized as a chaise lounge.

However, to completely release the ratchet and pawl mechanism within the backrest inclination adjustment devices 90, the backrest framework 86 can be moved all the way forward in a counterclockwise direction to the position indicated in solid lines in FIG. 4. At this point, the catch mechanisms of the backrest inclination adjustment devices 90 are disengaged and the backrest 85 can be freely rotated all the way down into a flat, coplanar relationship relative to the peripheral framework 82, as illustrated in FIG. 1.

The backrest inclination adjustment devices 90 connect the backrest framework 86 of the interior backrest 85 to the peripheral framework 82 of the proximal back frame 28 at a backrest axis of rotation 92, which extends transversely across the article of furniture 10, as illustrated in FIG. 1. The backrest inclination adjustment devices 90 include catch mechanisms for holding the backrest 85 at a selected acute angle relative to the peripheral framework 82 of the proximal back frame 28. However, the catch mechanisms are releaseable to allow the backrest 85 to reside in coplanar relationship with the peripheral framework 82, as illustrated in FIG. 6.

The proximal back frame 28 is rotatably secured to the side frames 18 and 20 by transverse back frame axle pins 94 that are located proximate the head frame 16. That is, the back frame axle pins 94 extend through the upper side rails 64 of the side frames 18 and 20 and into the outer peripheral framework 82 of the proximal back frame 28. The proximal back frame 28 is thereby rotatably mounted within the side frames 18 and 20 for rotation relative thereto about the proximal back frame axis of rotation 96, which is perpendicular to the side frames 18 and 20. The back frame axle pins 94 join the proximal back frame 28 to the side frames 18 and 20 at a spaced distance of separation from the head frame 16. This distance may, for example, be between about six inches and twenty-four inches, depending upon the size of the article of furniture 10.

The peripheral framework 82 of the proximal back frame 28 is thereby rotatably joined by the back frame axle pins 94 to the side frames 18 and 20, while the interior backrest 85 is mounted within the peripheral framework 82 for rotation about the backrest axis of rotation 92 that is parallel to the proximal back frame axis of rotation 94. The backrest axis of rotation 92 is located at the distal portion of the proximal back frame 28 near its hinged connection with the intermediate back frame 26 to which it is coupled by the hinges 32. The proximal back frame 28 includes a proximal portion 97 and a distal portion 99, which may be considered to be delineated from each other by the back frame axis of rotation 94. The proximal back frame portion 97 fits within the spaced distance of separation of the back frame axle pins 94 from the transverse rails 50 of the head frame 16.

The cam latch mechanism, which forms a very important aspect of the invention, is illustrated in FIGS. 7 through 11. As illustrated in FIG. 1, the article of furniture 10 may be utilized as a bed in which the seat bench frame 24, the intermediate back frame 26, and the proximal back frame 28 all lie in coplanar alignment with each other. When the article of furniture 10 is deployed for use as a bed, the seat bench frame 24 resides at the location must remote from the head frame 16, while the proximal back frame 28 is closest to the head frame 16.

The seat bench frame 24 is supported from beneath by a pair of longitudinally aligned, transversely separated, U-shaped mounting leg structures 100 which are equipped with central, longitudinal portions 102. The linear portions 102 are bolted to the two outboard longitudinal stiffening members 78 that are located closest to the longitudinal sides of the peripheral framework 76. The mounting leg structure 100 also has depending distal legs 104 and proximal legs 106 that extend downwardly from the linear portions 102. The wheels 22 are mounted on the lower extremities of the leg portions 104 and 106. The wheels 22 are mounted for rotation about transverse axes of rotation relative to the legs 104 and 106. It is to be understood that rollers or casters could be substituted for the wheels 22, if desired.

When the article of furniture 10 is deployed in the condition of a bed, as illustrated in FIG. 1, the back rest 85 resides in coplanar relationship within the peripheral framework 82 of the proximal back frame 28. The peripheral framework 82 of the proximal back frame 28 rests upon proximal and distal flat, horizontal flanges 108, which are welded to and extend inwardly from the inside surfaces of the upper longitudinal rails 64 of the side frames 18 and 20. Normally the weight of a person or any other weight lying atop the article of furniture 10 employed in the bed position of FIG. 1 is transmitted to the floor surface supporting the article of furniture 10 through the legs 104 and 106 and the wheels 22 beneath the seat bench frame 24 and through disc-shaped rubber pads (not visible) located on the undersides of the outboard longitudinal members of the peripheral framework 82 of the proximal back frame 28, which rest upon the flanges 108.

When a user desires to convert the article of furniture 10 from a bed, as illustrated in FIG. 1, to a chaise lounge, as illustrated in FIG. 3, the user lifts upwardly upon the transverse member of the backrest framework 86 located closest to the end frame 16 to raise the backrest 85, as illustrated in FIG. 3. In this drawing figure an elongated, rectangular cushioning pad 110 is shown resting atop the frames 24, 26, and 28 of the movable base frame assembly 14. The cushioning pad 110 is normally formed of foam rubber or some other soft, cushioning material, encapsulated within an outer protective cover. To hold the pad 110 in position on the movable base frame assembly 14, the pad 110 is provided with a flap forming a pocket 112 on its underside at its proximal end. The pocket flap 112 fits over the backrest framework 86 to aid in holding the pad 110 in position on the movable base frame assembly 14. When the article of furniture 10 is utilized as a chaise lounge, the natural resiliency of the pad 110 may cause the proximal portion of the pad 110 to pull away from the backrest 85 slightly, as illustrated in FIG. 3. However, if the chaise lounge is occupied by a person, the proximal portion of the pad 110 will be pressed back against the backrest 85.

The article of furniture 10 may also be utilized as a roll-in futon. To transform the article of furniture 10 for this use, the intermediate back frame 26 is provided with a pair of knobs 113, projecting transversely outwardly in front of the distal support posts 68. To deploy the article of furniture 10 as a futon, the back rest 86 is first moved all the way in a counterclockwise direction to release the ratchet and pawl catch mechanism, as shown in FIG. 4, and then lowered all the way back down in a clockwise direction as illustrated at 85' into the plane of the surrounding peripheral framework 82. The article of furniture 10 is thereupon in the condition illustrated in FIG. 1 for use as a bed.

To continue conversion of the device to use as a futon, a user lifts the proximal portion of the intermediate back frame 26 upwardly utilizing the knobs 113, as illustrated in FIG. 2. The proximal back frame 28 thereupon rotates about the back frame axle pins 94 as the seat bench frame 24 rolls in toward the stationary outer support 12, as illustrated by the directional arrow 114 indicated in FIG. 2. Since the proximal back frame 28 and the intermediate back frame 26 are hinged together on the undersides of their respective peripheral frameworks 82 and 77 by the hinges 32, the proximal back frame 28 will rotate upwardly in a clockwise direction about the back frame axle pins 94, while the intermediate back frame 26 rotates in a counterclockwise direction relative to the proximal back frame 28 by virtue of its articulated, hinged connection to the distal end of the proximal back frame 28. Meanwhile, the seat bench frame 24 remains in a horizontal orientation and moves inwardly in between the side frames 18 and 20, as indicated by the directional arrow 114 in FIG. 2. The hinges 30 allow relative rotation to occur between the intermediate back frame 26 and the seat bench frame 24.

Figure 7:
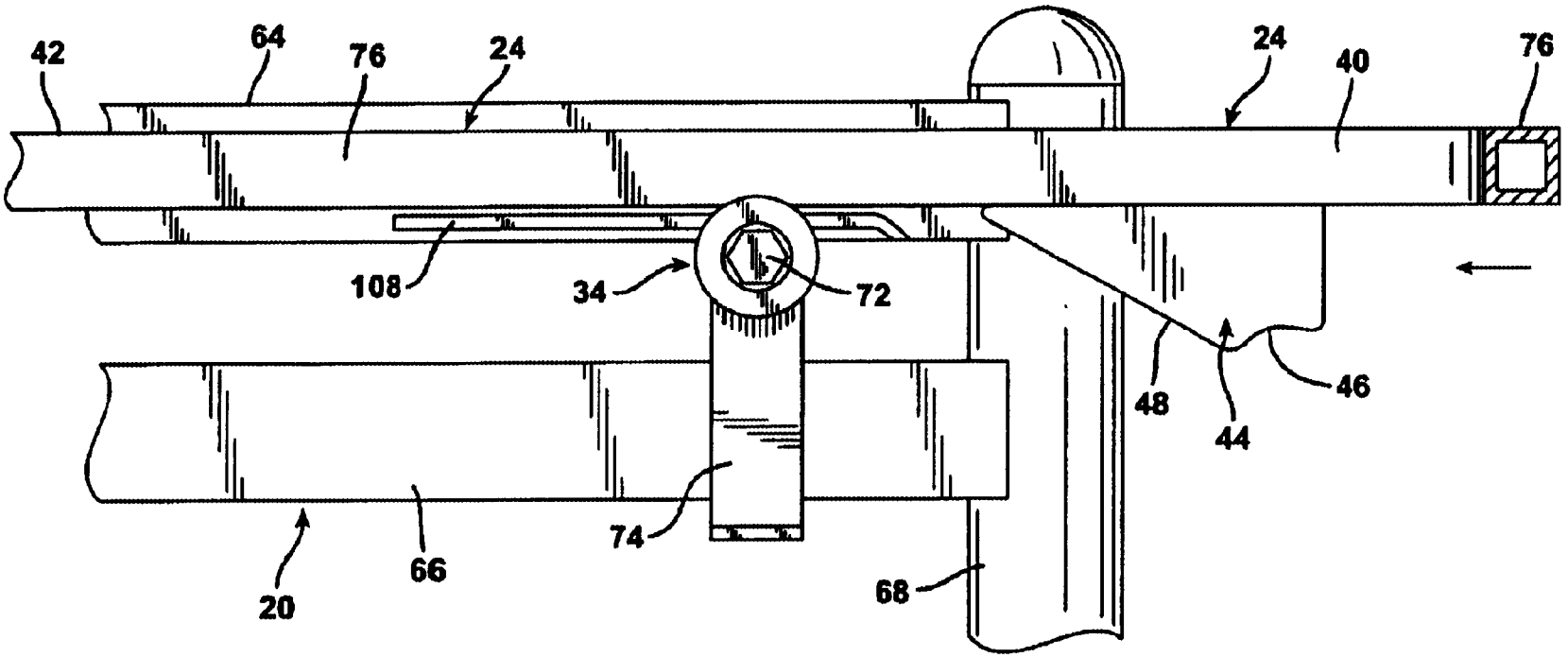
FIG. 7 is a sectional elevational detail illustrating the seat bench frame of the article of furniture as it approaches the futon position shown in FIG. 5.
Figure 8:
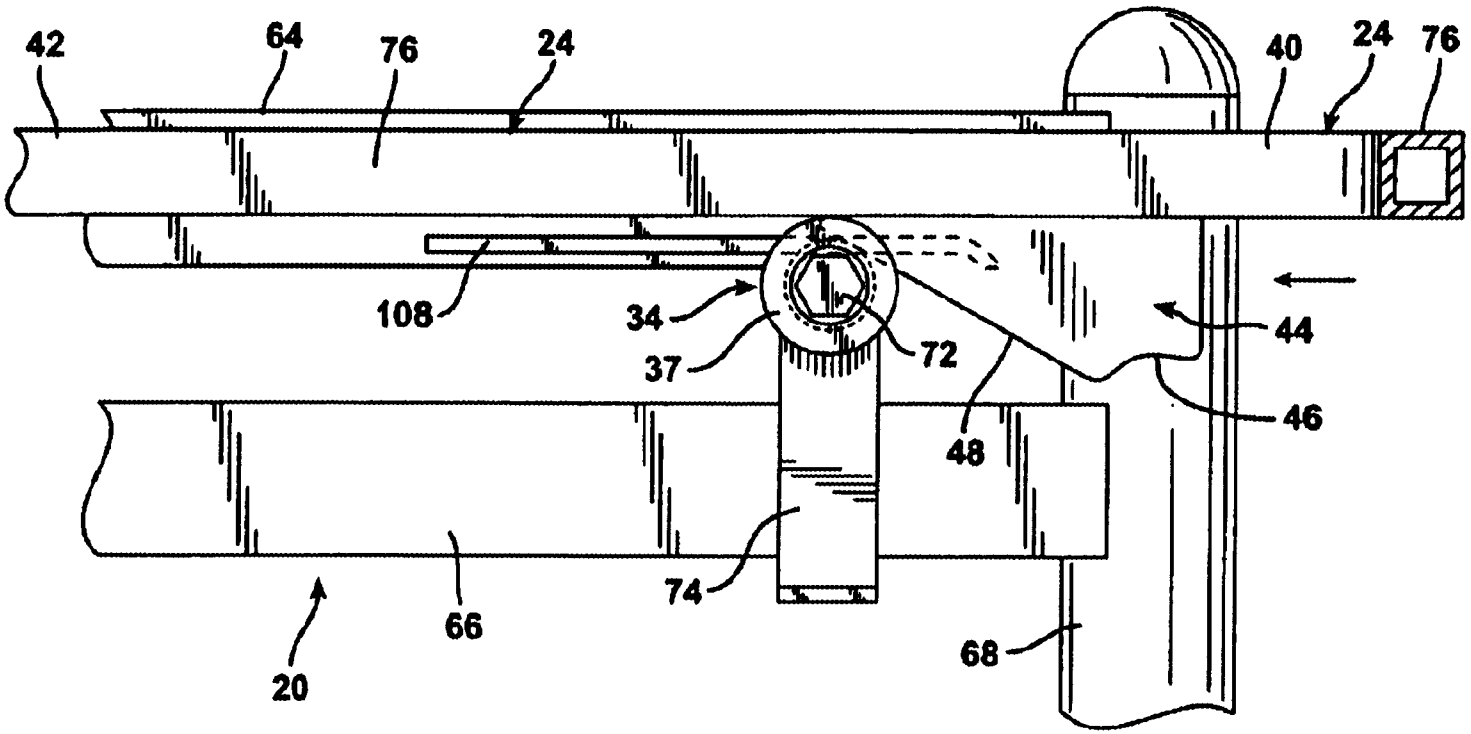
FIG. 8 illustrates the initial engagement of the roller with the cam surface as the base frame assembly is rolled into the stationary outer support.
Figure 9:
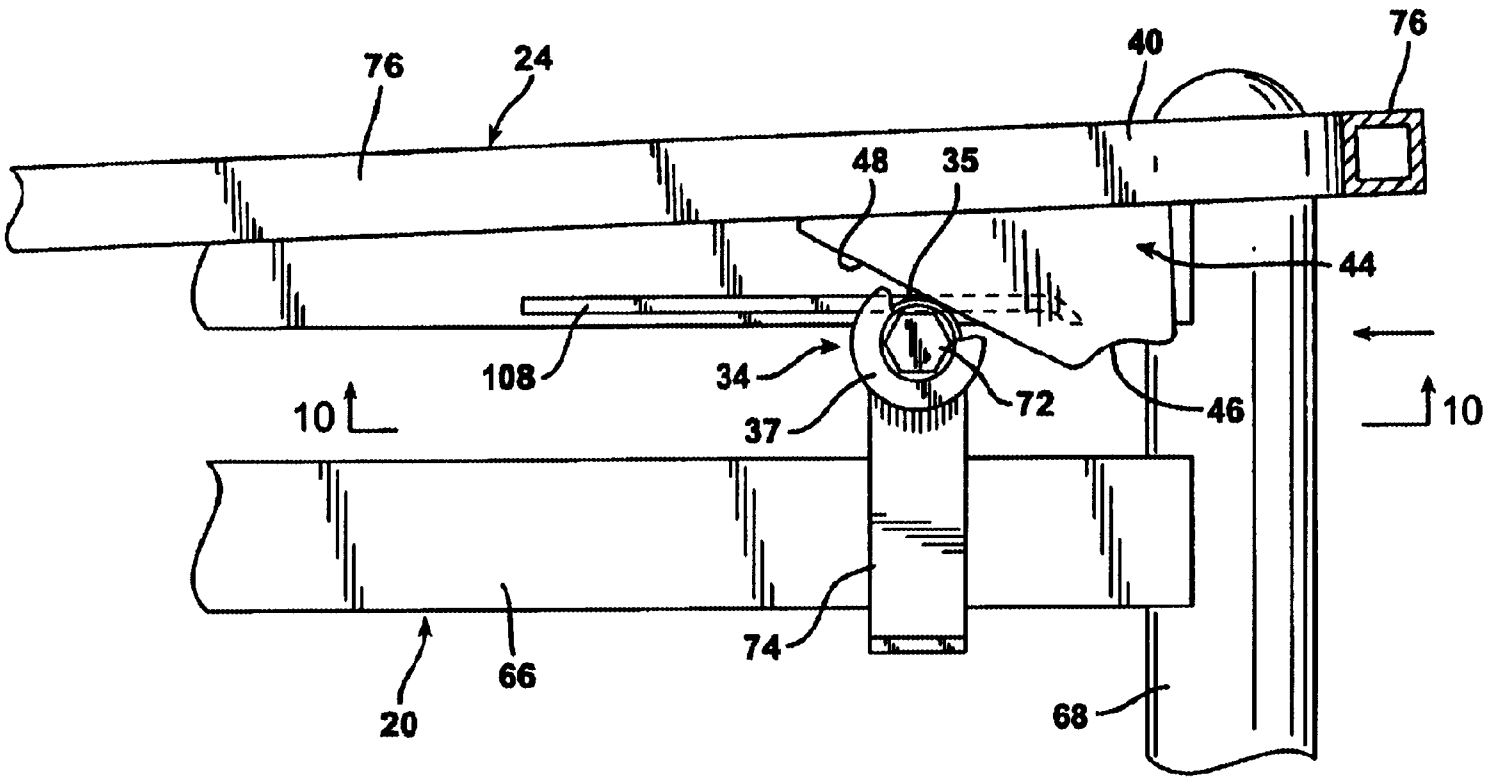
FIG. 9 illustrates the engagement of the roller (shown partially broken away) at about the middle of the inclined cam surface of the cam latch plate.

As the seat bench frame 24 is rolled in toward the head frame 16 between the side frames 18 and 20 to approach the head frame 16, the cam latch 44 approaches the roller 34, as illustrated in FIG. 7. As the seat bench frame 24 continues to roll in to approach the head frame 16, the inclined cam surfaces 48 of the cam latches 44 are brought into contact with the cylindrical roller contact surfaces 35 of the rollers 34, as shown in FIG. 8. Continued advancement of the seat bench frame 24 toward the head frame 16 causes the inclined cam surfaces 48 of the cam latches 44 to ride up the rollers 34 in the manner illustrated in FIG. 9. This causes the wheels 22 on the distal legs 104 to leave the floor surface upon which the article of furniture 10 is placed and for the seat bench frame 24 then to be inclined slightly downwardly toward the head frame 16. The distal portion 40 of the seat bench frame 24 residing above the distal legs 104 is thereby lifted slightly as the inclined cam surfaces 48 progress across the rolling surfaces 35 of the rollers 34.

The roller 34 has a cylindrical roller surface of contact 35 which has a diameter of about seven-eighths of an inch. The concave recess 46 is shaped with a circular arc centered on a diameter of about one and three-eighths inches and extending over an arc of about sixty degrees. The flanges 108 are located slightly above the rolling surfaces 35 of the rollers 34 and extend horizontally inwardly from the opposing side frames 18 and 20 beneath the movable base frame assembly 14. The wheels 22 support the movable base frame assembly 14 so that there is a slight clearance between the underside of the peripheral framework 76 of the seat bench frame 24 and the distal flange plates 108 located proximate the upright posts 68.

As the distal extremity of the seat bench frame 24 passes alignment with the distal support posts 68, the cam surfaces 48 leave contact with the rollers 34, and the concave, arcuate, downwardly facing seating recesses 46 are brought into contact with the contact surfaces 35 of the rollers 34. Because of the configuration of the seating recesses 46, the cam latches 44 drop downwardly slightly, thereby lodging the concave seating recesses 46 of the cam latches 44 onto the rollers 34 while the longitudinally distal extremity 40 of the seat bench frame 26 is elevated slightly, as illustrated in FIG. 11. When the cam latch mechanisms are engaged as illustrated in FIG. 11, the article of furniture 10 is deployed for use a futon, as illustrated in FIGS. 5 and 6.

To disengage the cam latching mechanisms, a user merely grasps the transverse, distal portion of the peripheral framework 76 of the seat bench frame 24 from its underside and pulls slightly upwardly and slightly away from the head frame 16, in the direction indicated by the directional arrow 115 in FIG. 6. This will dislodge the seating recesses 46 from the contact surfaces 35 of the rollers 34. The seat bench frame 24 can then be pulled longitudinally outwardly away from the head frame 16 and rolled on all the wheels 22 out away from the head frame 16 in the longitudinal direction 115 opposite to the direction indicated by the directional arrow 114 in FIG. 2. The article of furniture 10 can thereafter be deployed as either a bed, in the manner illustrated in FIG. 1, or as a chaise lounge, in the manner illustrated in FIG. 3.

Undoubtedly, numerous variations and modifications of the invention will become readily apparent to those familiar with articles of furniture and their construction. For example, there are many different backrest inclination adjustment devices that may be employed in place of the rachet and pawl mechanisms employed in the backrest inclination adjustment devices 90. Also, the configuration of the rollers 34 and the cam plates 44 may vary considerably depending upon the dimensions of the different frames of the article of furniture 10. In addition, the locations of the rollers 34 and the cam latches 44 are equivalent even if they are reversed. That is, the cam laches 44 can be located reversed in orientation and inverted so that the cam surfaces 46 are located further from the head frame 16 than the concave recesses, and the concave recesses 48 then face upwardly. The rollers that extend transversely outwardly from the seat bench frame 24 will then ride up the cam surfaces 46 and lodge in the seating recesses 48 when the article of furniture is to be utilized as a futon. Accordingly, the scope of the invention should not be construed as limited to the specific embodiment depicted and described, but rather is defined in the claims appended hereto and equivalent structures.

I claim:

1. A convertible article of furniture comprising:

a stationary outer support formed with a central, transverse head frame from both ends of which mutually parallel side frames extend longitudinally in spaced separation from each other, and a movable base frame assembly supported on rolling members for longitudinally reciprocal movement relative to said stationary outer support between said side frames and having a longitudinally distal seat bench frame and an intermediate back frame located between said seat bench frame and said head frame, and said seat bench frame and said intermediate back frame are hinged to each other, and said side frames are each provided with a roller located remote from said head frame and oriented for rotation about horizontal roller axes that are perpendicular to said side frames, and said seat bench frame has a distal portion longitudinally remote from said head frame, and cam latches with arcuate, downwardly facing concave seating recesses defined therein projecting downwardly from said distal portion of said seat bench frame and said cam latches include longitudinally oriented cam surfaces inclined in a direction downwardly and away from said head frame and toward said seating recesses, whereby as said seat bench frame approaches said head frame said cam surfaces ride up said rollers to elevate said longitudinally distal portion of said seat bench frame and then releaseably lodge said concave seating recesses upon said rollers.

2. A convertible article of furniture according to claim 1 wherein said base frame assembly further includes a proximal back frame hinged to said intermediate back frame and located between said intermediate back frame and said head frame, whereby said seat bench frame, said intermediate seat back frame and said proximal seat back frame are joined together in articulated fashion, and said proximal back frame is rotatably secured to said side frames at back frame axle pins located proximate said head frame for rotation relative to said side frames about a proximal back frame axis of rotation perpendicular to said side frames.

3. A convertible article of furniture according to claim 2 wherein said back frame axle pins join said proximal back frame to said side frames at a spaced distance of separation from said head frame and said proximal back frame includes opposing short and long portions delineated from each other by said proximal back frame axis of rotation, and said short portion of said proximal back frame fits within said spaced distance of separation.

4. A convertible article of furniture according to claim 3 wherein said proximal back frame is comprised of a peripheral framework rotatably joined by said axle pins to said side frames, and an interior backrest mounted within said peripheral framework for rotation about a backrest axis of rotation that is parallel to said proximal back frame axis of rotation, and said backrest axis of rotation is located at said long portion of said proximal back frame near its hinged connection with said intermediate back frame.

5. A convertible article of furniture according to claim 4 further comprising backrest latching coupling devices connecting said interior backrest to said peripheral framework at said backrest axis of rotation and said backrest latching coupling devices include catch mechanisms for holding said interior backrest at a selected acute angle relative to said peripheral framework and said catch mechanisms are releaseable to allow said backrest to reside in coplanar relationship with said peripheral framework.

6. A convertible article of furniture according to claim 1 wherein said cam latches include depending plates upon which said cam surfaces are formed at an angle of between about twenty-five degrees and about forty-five degrees relative to said seat bench frame.

7. A convertible article of furniture according to claim 1 wherein said cam surfaces of said cam plates-are inclined at an angle of about thirty-three degrees relative to said seat bench frame.

8. A convertible article of furniture according to claim 1 wherein said rollers are shaped with a diameter of between about one-half inch and about one and one-half inches.

9. A convertible article of furniture according to claim 8 wherein said rollers are shaped with a diameter of about seven-eighths of an inch.

10. A convertible article of furniture according to claim 1 wherein said concave recesses are both shaped with a circular arc having a diameter of between about one and two inches.

11. A convertible article of furniture according to claim 10 wherein said concave recess are both shaped with a circular arc having a diameter of about one and three-eighths inches.

12. A convertible article of furniture according to claim 10 wherein said seating recesses extend over a circular arc of about sixty degrees.

13. A convertible article of furniture according to claim 1 wherein said side frames are provided with flat flanges located above the level of said rollers that extend horizontally toward each other and are located beneath said movable base frame to provide support thereto from beneath.

14. A roll-in futon comprising:

a stationary outer support formed with a laterally extending head frame having opposing ends and a pair of mutually parallel side frames at said opposing ends of said head frame and extending in a footward direction therefrom, and rollers are rotatably mounted on said side frames for rotation about axes perpendicular thereto, a movable base frame assembly including a seat bench frame located in a footward direction from said head frame and at least one intermediate back support frame located between said head frame and said seat bench frame and joined by a footward hinge for movement relative to said seat bench frame, and said seat bench frame is equipped with supporting rolling members whereby said base frame assembly is supported for rolling, longitudinal movement between said side frames, and cam latches that project downwardly from said seat frame and which include concave downwardly facing seating recesses and cam surfaces inclined upwardly therefrom and toward said head frame, and said rollers engage said cam latches as said intermediate back support frame approaches said head frame and said rollers lift at least a portion of said seat frame as said cam surfaces ride up said rollers and said seat frame is releaseably lodged relative to said stationary support when said rollers engage said concave seating surfaces of said cam latches.

15. A roll-in futon according to claim 14 wherein said rollers have a diameter of between about one-half inch and one and one-half inches, and said seating recesses have a circular arcuate configuration extending over an arc of between about thirty and ninety degrees.

16. A roll-in futon according to claim 15 wherein said circular arcuate configuration of said seating recesses is at a diameter of between about one and two inches.

17. A roll-in futon according to claim 16 wherein said circular arcuate configuration of said seating recesses is at a diameter of about one and three-eighths inches.

18. In an article of furniture having a stationary support with upright, mutually parallel opposing sides and a base frame assembly movable between said opposing sides and parallel thereto and in which said base frame assembly includes a seat bench frame and at least an intermediate seat back frame hinged to said seat bench frame for rotational movement relative thereto and said seat bench frame is provided with supporting rolling members, the improvement comprising a roller on each of said sides of said stationary support oriented for rotation about axes perpendicular to said sides of said stationary supports, and cam latches are provided on opposing sides of said seat bench frame in longitudinal alignment with said rollers and said cam latches include concave downwardly facing seating recesses and cam surfaces inclined longitudinally upwardly and toward said intermediate seat back frame therefrom, whereby when said seat bench frame is moved to engage said cam latches with said rollers said cam surfaces of said cam latches ride up said rollers and said seating recesses lodge on said rollers in releaseable latching engagement therewith when moved into registration with said rollers.

19. An article of furniture according to claim 18 wherein said cam surfaces are inclined relative to said seat bench frame at an angle of between about twenty-five and forty degrees.

20. An article of furniture according to claim 18 which is alternatively convertible to a futon, a chaise lounge, and a bed.

* * * * *